US005860436A

United States Patent [19]

Hobday

[11] Patent Number: 5,860,436

[45] Date of Patent: Jan. 19, 1999

[54] OFFSET LEG

[75] Inventor: Bradley B. Hobday, Goldsboro, N.C.

[73] Assignee: White Consolidated Industries, Inc., Cleveland, Ohio

[21] Appl. No.: 690,558

[22] Filed: Jul. 31, 1996

[51] Int. Cl.[6] ..... B08B 3/02

[52] U.S. Cl. ..... 134/58 D; 134/201; 134/200; 68/3 R; 312/228

[58] Field of Search ..... 134/56 D, 57 D, 134/58 D, 201, 200; 312/228; 68/3 R

[56] References Cited

U.S. PATENT DOCUMENTS

| | | | |
|---|---|---|---|
| 1,628,865 | 5/1927 | Webster . | |
| 3,738,727 | 6/1973 | Race et al. . | |
| 3,811,746 | 5/1974 | Butsch et al. | 312/228 |
| 3,822,029 | 7/1974 | Butsch | 134/200 |
| 4,128,287 | 12/1978 | Loch et al. . | |
| 4,295,692 | 10/1981 | Jenkins . | |
| 4,359,250 | 11/1982 | Jenkins . | |
| 4,371,223 | 2/1983 | Grunert et al. . | |
| 4,746,177 | 5/1988 | Lampman et al. . | |
| 4,758,057 | 7/1988 | Spiegel . | |
| 4,776,620 | 10/1988 | Marks et al. . | |
| 4,826,118 | 5/1989 | Swinderman . | |
| 4,900,109 | 2/1990 | Boston, Jr. et al. . | |
| 4,940,298 | 7/1990 | Jackson et al. . | |
| 5,345,959 | 9/1994 | Matteson | 134/201 |
| 5,365,959 | 11/1994 | Favaro . | |
| 5,613,747 | 3/1997 | Becker et al. | 134/228 |

FOREIGN PATENT DOCUMENTS

| | | | |
|---|---|---|---|
| 2937405 | 4/1981 | Germany | 134/201 |
| 3345604 | 7/1985 | Germany | 134/57 D |
| 2066064 | 7/1981 | United Kingdom | 134/201 |

*Primary Examiner*—Frankie L. Stinson
*Attorney, Agent, or Firm*—Pearne, Gordon, McCoy & Granger LLP

[57] ABSTRACT

A washer having a pair of offset legs. In addition to the offset legs, the washer includes a tub, a front frame and a rear frame. The tub defines a wash chamber with a front opening and includes a bottom wall and opposing side walls. The front frame has a pair of legs respectively disposed adjacent to the opposing side walls of the tub toward the front opening. The rear frame has a pair of horizontal legs with outer ends and a pair of vertical supports. The vertical supports are disposed rearward from the legs of the front frame. The horizontal legs are secured to the vertical supports and extend forward therefrom to the outer ends. The offset legs each have a neck and an upright member. The necks are offset forward of the upright members and are respectively secured to the legs of the front frame. The upright members are respectively secured to the horizontal legs toward the outer ends.

20 Claims, 5 Drawing Sheets

OFFSET LEG

BACKGROUND OF THE INVENTION

1. Field of the Invention

This invention relates to washers in general and, more particularly, to support structures for dishwashers.

2. Description of the Related Art

A tub for a washer, such as dishwasher, often has an integrally molded plastic construction and a front opening for providing access to an interior wash chamber. Typically, the tub includes a pair of side walls and a top wall, all of which flare outward near the front opening so as to form a collar with a recessed shoulder. The recessed shoulder provides a seat for a door that closes the front opening.

With plastic tubs, a front frame and a rear frame are provided to support the tub. Typically, the front frame is horseshoe-shaped and has a pair of parallel vertical legs that project downward from a bight. The front frame abuts an exterior surface of the collar and helps prevent lateral movement of the tub. The rear frame usually has a support member that is secured to a pair of horizontal legs that project forward toward the front of the tub. Usually, the vertical legs of the front frame extend downward to the horizontal legs of the rear frame and are secured thereto.

A pair of mounting plates are secured to the vertical legs to provide a mount for the door that closes the front opening in the tub. Each mounting plate has a base and an outer end. The bases are secured to the vertical legs by welding or other means.

The door usually has opposing sides with hinge arms secured thereto. Each of the hinge arms typically has an elongated body and a head with an opening formed therein. The door is pivotally secured to the mounting plates by pintles that extend through the openings in the heads. The pintles are either secured to the outer ends of the mounting plates or are pivotally received within holes formed in the outer ends of the mounting plates. The door is movable between a closed position wherein the door covers the front opening and an open position wherein the door is spaced from the front opening. In the closed position, the door is substantially vertical, while in the open position, the door is substantially horizontal.

The lengths of the mounting plates between the bases and the outer ends are sized to permit a bottom portion of the door to pivot underneath the mounting plates when the door is pivoted from the closed position to the open position. Since in most prior art washers the door pivots about a horizontal axis that passes through the door at or near a bottom edge of the door, the bottom portion of the door is small. Accordingly, the mounting plates are short. If, however, the horizontal axis is spaced upward from the bottom edge, the bottom portion of the door will be large. Such a door, often called a "long door", requires mounting plates that are long. In order to accommodate long mounting plates, the front frame of the washer must be set back farther from the front opening, which is undesirable. The farther the front frame is set back, the less support the front frame provides to the tub around the front opening. Accordingly, there is a need in the art for a washer having a structure that provides a pivot connection for a long door without requiring a front frame to be set back from a front opening. The present invention is directed to such a washer.

SUMMARY OF THE INVENTION

It therefore would be desirable, and is an advantage of the present invention, to provide a washer having a structure that provides a pivot connection for a long door without requiring a front frame to be set back from a front opening. In accordance with the present invention, a washer is provided for placement on a surface. The washer includes a tub, a front frame and a pair of offset legs. The tub defines a wash chamber with a front opening. The tub has a bottom wall and opposing side walls. The front frame has a pair of legs respectively disposed adjacent to the opposing side walls of the tub toward the front opening. The offset legs help vertically support the tub above the surface. The offset legs each have a neck and an upright member longitudinally offset from each other. The necks are respectively secured to the legs of the front frame.

Also provided in accordance with the present invention is a washer having a tub, a front frame, a rear frame and a pair of offset legs. The tub defines a wash chamber with a front opening. The tub has a bottom wall and opposing side walls. The front frame has a bight with a pair of legs extending downward therefrom. The legs are respectively disposed adjacent to the opposing side walls of the tub toward the front opening. The rear frame has a pair of horizontal legs with outer ends and a pair of vertical supports disposed rearward from the legs of the front frame. The horizontal legs are secured to the vertical supports and extend forward therefrom to the outer ends. The offset legs each have a neck and an upright member longitudinally offset from each other. The necks are respectively secured to the legs of the front frame and said upright members are respectively secured to the horizontal legs toward the outer ends.

A portable washer is also provided in accordance with the present invention. The portable washer includes a tub, a front frame, a rear frame, a pair of offset legs and a base. The tub defines a wash chamber with a front opening. The tub has a bottom wall and opposing side walls. The front frame has a bight with a pair of legs extending downward therefrom. The legs are respectively disposed adjacent to the opposing side walls of the tub toward the front opening. The rear frame has a pair of horizontal legs and a pair of vertical supports. The vertical supports are disposed rearward from the legs of the front frame. The horizontal legs are secured to the vertical supports and extend forward therefrom. The offset legs each have a neck and an upright member longitudinally offset from each other. The necks are disposed forward of the upright members and are respectively secured to the legs of the front frame, while the upright members are respectively secured to the horizontal legs. The horizontal legs of the rear frame are secured to the base. The base has a plurality of casters extending downward therefrom.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
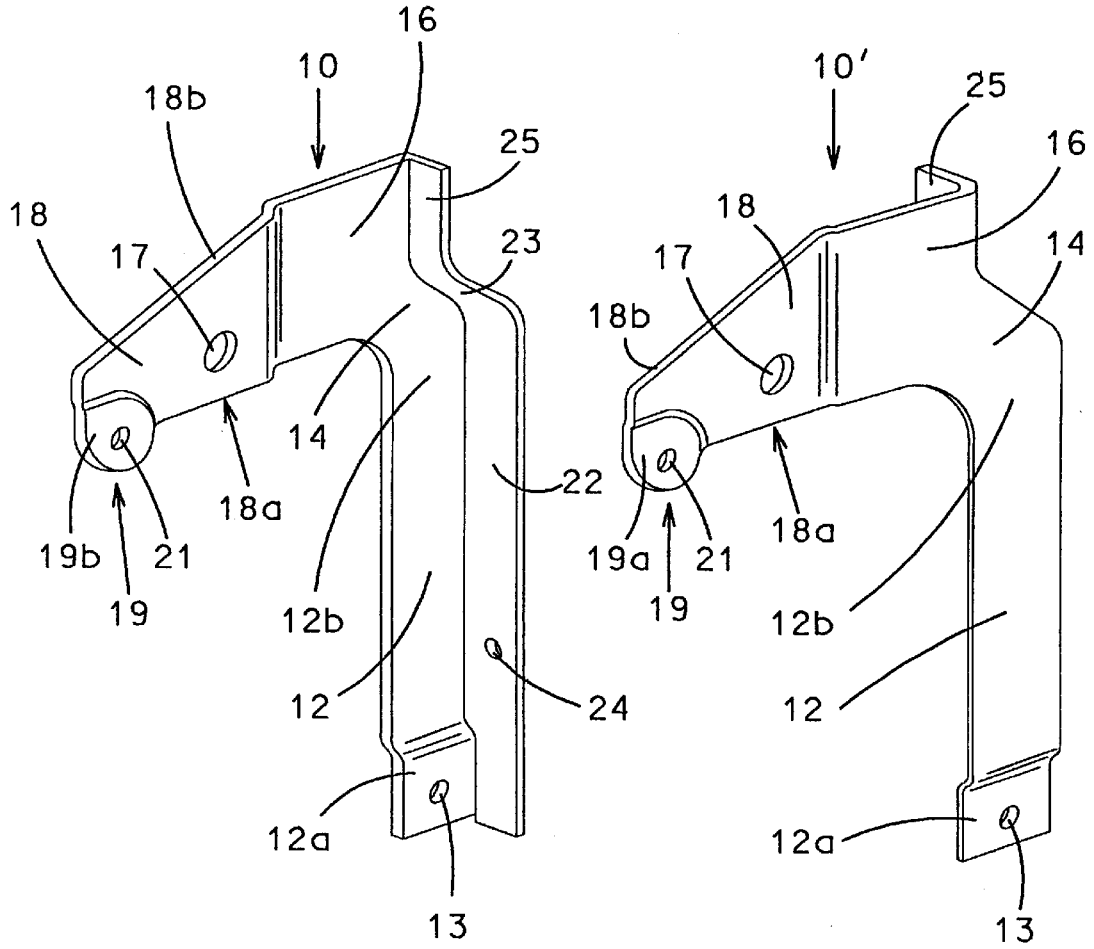
FIG. 1 shows a front perspective view of a pair of offset legs.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1 there is shown a perspective view of a first offset leg 10 and a second offset leg 10', both of which are embodied in accordance with the present invention. The first offset leg 10 and the second offset leg 10' are mirror images of each other and are each formed from a single piece of rigid steel. The first offset leg 10 and the second offset leg 10' each include an upright member 12, a shoulder 14, a neck 16 and a nose 18.

The upright member 12 has a lower end 12*a* and an upper end 12*b*. The lower end 12*a* has an indented outer surface and a raised inner surface. A hole 13 is formed in the lower end 12*a*. The upper end 12*b* is integrally joined with the shoulder 14, which extends upward and forward from the upright member 12 to the neck 16. An upright flange 22 extends inward from a rear edge of the upright member 12, while a shoulder flange 23 extends inward from a rear edge of the shoulder 14. The upright flange 22 defines a hole 24 disposed toward the lower end 12*a*.

The neck 16 is integrally joined with the shoulder 14 and extends upward therefrom. In this manner, the shoulder 14 offsets the neck 16 from the upright member 12 so that the neck 16 is disposed forward of the upright member 12. A neck flange 25 extends inward from a rear edge of the neck 16 and is integrally joined with the shoulder flange 23, which is, in turn, integrally joined with the upright flange 22.

The nose 18 is integrally joined with the neck 16 and has a bottom edge 18*a*, a downward sloping top edge 18*b* and a mounting projection 19. The nose 18 is inwardly offset from the neck 16 so as to form a vertical ridge at the juncture of the neck 16 and the nose 18. A circular opening 17 is formed in the nose 18 toward the vertical ridge. The nose 18 extends forward from the neck 16 to the mounting projection 19. The mounting projection 19 has an indented outer surface 19*a* and a raised inner surface 19*b*. The mounting projection 19 defines a mounting hole 21 and has an arcuate bottom edge that extends downward from, and is adjoined to, the bottom edge 18*a*.

Figure 2:
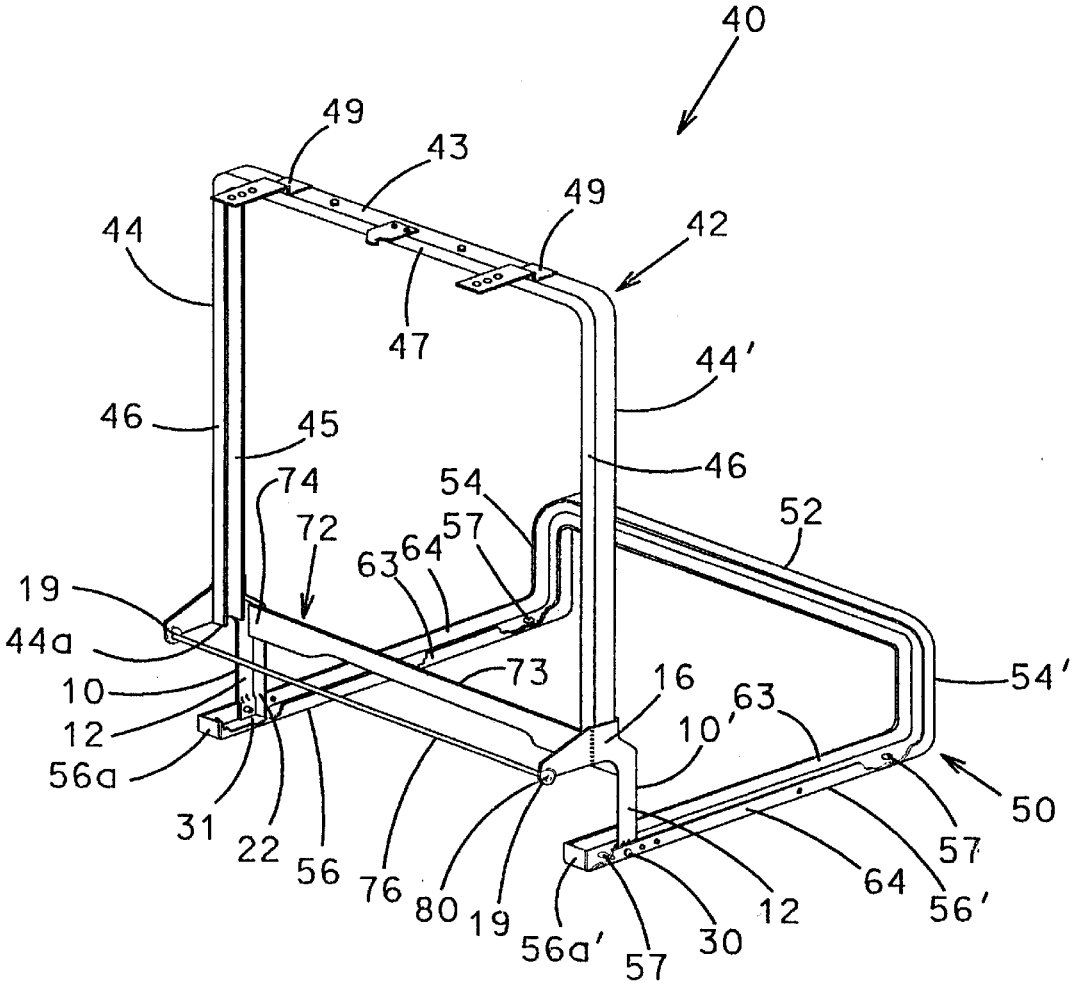
FIG. 2 shows a front perspective view of a frame including the offset legs.

Referring now to FIG. 2 there is shown a front perspective view of a frame 40 that includes the first and second offset legs 10, 10' as well as a door or front frame 42, a support or rear frame 50, a front brace 72 and a door hinge support 76.

The front frame 42 is composed of steel and has a channel-shaped cross-section. The front frame 42 is formed to have an inverted U-shaped configuration and includes a bight 43, first and second downward-projecting legs 44, 44', and a pair of mounting clips 49. The first downward-projecting leg 44 has a lower end 44*a* and the second downward-projecting leg 44' has a lower end (not shown). In addition, the first and second downward-projecting legs 44, 44' each have an interior flange 45 and an exterior flange 46 that extend inward. The bight 43 has an interior flange (not shown) and an exterior flange 47 that extend downward. The mounting clips 49 are secured to the bight 43 and extend forward therefrom.

The rear frame 50 is also composed of steel and has a channel-shaped cross-section. The rear frame 50, however, is formed to have a folded U-shaped configuration and includes a horizontal cross bar 52 with opposing ends that bend into first and second vertical supports or legs 54, 54'. The first and second vertical legs 54, 54', in turn, respectively bend into first and second horizontal legs 56, 56' that extend forward and terminate at outer ends 56*a*, 56*a'* respectively. A plurality of vertical holes 57 are formed in each of the first and second horizontal legs 56, 56'.

The first and second horizontal legs 56, 56' each have an inner flange 63 and an outer flange 64 that extend upward. Lateral bores are formed in the outer flanges 64 toward the outer ends 56*a*, 56*a* ' of the first and second horizontal legs 56, 56'. The lateral bores are aligned with the holes 13 in the upright members 12 of the first and second offset legs 10, 10'. The first and second horizontal legs 56, 56' are respectively secured to the lower ends 12*a* of the first and second offset legs 10, 10' by bolts. The bolts have heads 30 disposed adjacent to exterior sides of the outer flanges 64. The bolts extend through the lateral bores and the holes 13 in the lower ends 12*a* and are fitted with nuts 31 disposed adjacent to the interior surfaces of the lower ends 12*a*.

The lower end 44*a* of the first downward-projecting leg 44 is secured to the neck 16 of the first offset leg 10, while the lower end of the second downward-projecting leg 44' is secured to the neck 16 of the second offset leg 10'. The first and second downward-projecting legs 44, 44' are secured to the necks 16 using metal clinches. As used herein, the term "metal clinch" shall refer to a joint formed by a TOX® round joint method.

The TOX® round joint method is a method of joining two pieces of metal covered by European Patent No. EP 0 215 449 and marketed by TOX-PRESSOTECHNIK, INC. of Addison, Ill. In the TOX® round joint method a round punch presses a top material and a bottom material into a die cavity. As force is increased on the punch, the top material is forced to spread out within the bottom material, thereby forming a metal clinch that joins the top and bottom materials. The metal clinch resembles a dove-tail joint. It is considered apparent that the present invention is not limited to the use of metal clinches to join the various components of the frame 40. Other joining means such as welding may be employed with equal functionality and without departing from the scope and spirit of the present invention as embodied in the claims appended hereto.

Three metal clinches are formed between the lower end 44*a* of the first downward-projecting leg 44 and the neck 16 of the first offset leg 10. Three metal clinches are also formed between the lower end of the second downward-projecting leg 44' and the neck 16 of the second offset leg 10'. With the first and second downward-projecting legs 44, 44' secured to the first and second offset legs 10, 10' in this manner, the interior flanges 45 of the first and second downward-projecting legs 44, 44' adjoin the neck flanges 25 on the first and second offset legs 10, 10'. In addition, the exterior flanges 46 on the first and second downward-projecting legs 44, 44' adjoin the vertical ridges in the first and second offset legs 10, 10'.

The front brace 72 is comprised of metal and has a narrow middle portion 73, a first end 74 and a second end (not shown). The front brace 72 is secured between the first and second offset legs 10, 10'. Specifically, the first end 74 of the front brace 72 is secured to the upright flange 22 of the first offset leg 10 by two metal clinches, while the second end of the front brace 72 is secured to the upright flange 22 of the second offset leg 10' by two metal clinches.

The door hinge support 76 is composed of aluminum and has a cylindrical body with a plurality of fins extending the length thereof. The cylindrical body has a hollow interior with opposing open ends. The door hinge support 76 is secured between the mounting projections 19 of the first and second offset legs 10, 10' by hinge pins 80. The hinge pins 80 extend through the mounting holes 21 in the mounting projections 19 and are securely received in the open ends of the door hinge support 76. The structure and mounting of the door hinge support 76 is more fully described in assignee's co-pending application entitled "Support-Door Hinge", Ser. No. 08/692,745, U.S. Pat. No. 5,758,676 which is incorporated herein by reference.

Figure 3:
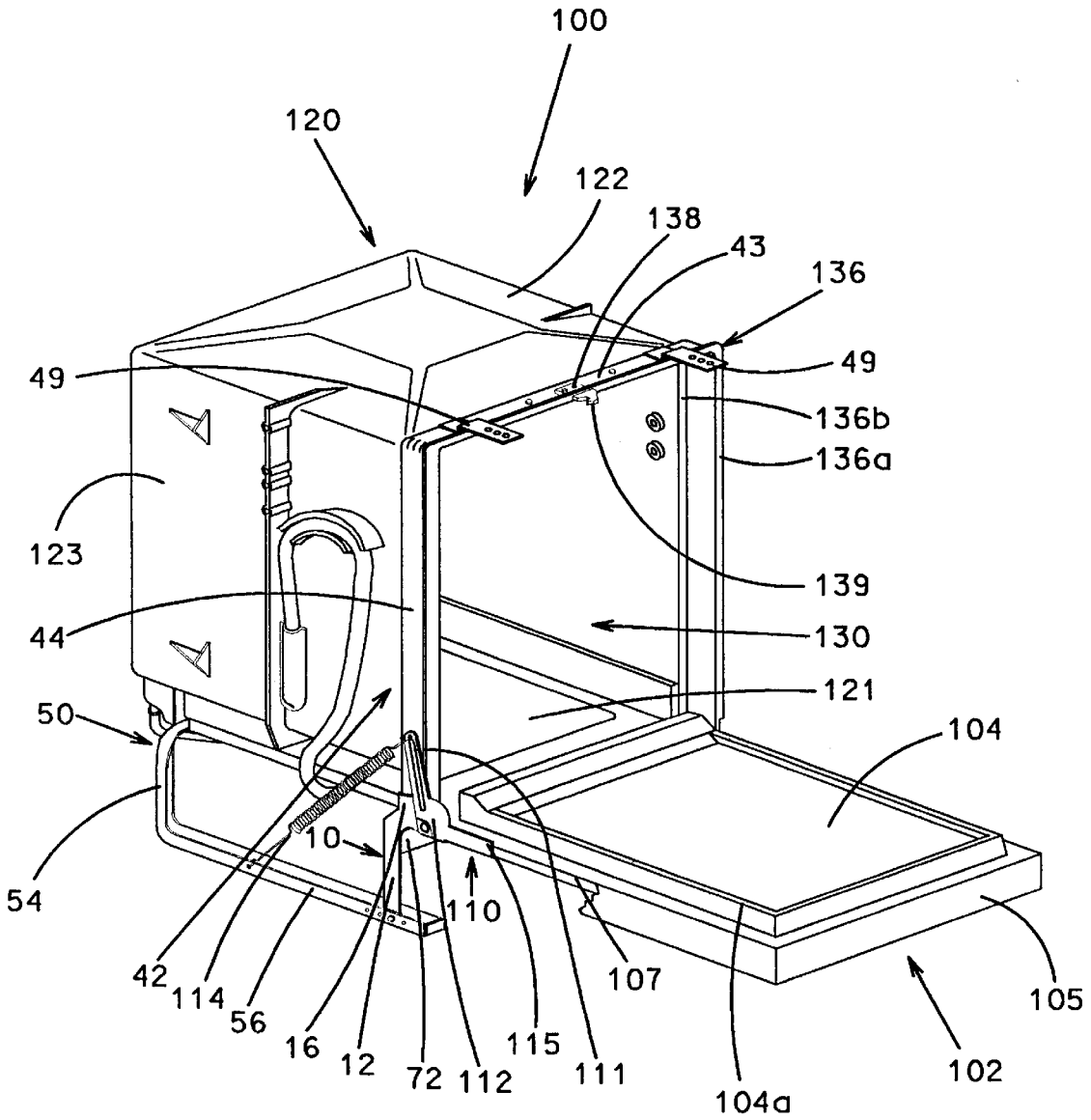
FIG. 3 shows a front perspective view of a washer including the frame.

Referring now to FIG. 3 there is shown a perspective view of a washer 100, such as a dishwasher, that generally includes the frame 40, a door 102, and a tub 120. The tub 120 has an integrally molded plastic construction and defines a front or access opening 130. The tub 120 includes a bottom wall 121, a top wall 122, a pair of opposing side walls 123 and a rear wall (not shown). The exterior of the bottom wall 121 has integrally molded ribs (not shown) and blocks (not shown) projecting downward therefrom. The blocks are cantilevered and form grooves with the ribs. The side walls 123 and the top wall 122 flare outward near the access opening 130 so as to form a collar 136 around the access opening 130. The collar 136 has an outer flange 136*a* and an interior recessed shoulder 136*b* that provides a seat for the door 102.

The front frame 42 is disposed around the collar 136 of the tub 120 on an interior side of the outer flange 136*a*. A mounting plate 138 is centrally mounted to the bight 43 of the front frame 42 on the interior side of the outer flange 136*a*. Located on an exterior side of the outer flange 136*a* is a striker 139. The mounting plate 138 and the striker 139 are secured together with the outer flange 136*a* firmly clamped in between. In this manner, the front frame 42 is rigidly attached to the tub 120.

The horizontal cross bar 52 of the rear frame 50 supports a rear portion of the bottom wall 121 of the tub 120, while the front brace 72 supports a front portion of the bottom wall 121 of the tub 120. The horizontal cross-bar 52 is disposed within the grooves between the ribs and the blocks so as to prevent forward and rearward movement of the tub 120 as well as upward and downward movement of the tub 120.

The door 102 includes a reinforcement frame, a liner 104 and an outer panel 105. The reinforcement frame has a pair of opposing side members 107 with hinge arms 110 secured thereto. Each of the hinge arms 110 is substantially L-shaped and has an elongated member 111, a mounting member 115 and an elbow 112 with an opening formed therein. An annular bearing surface (not shown) is disposed around an inner periphery of each of the openings. The elbows 112 are respectively disposed adjacent to the first and second offset legs 10, 10' such that the openings in the elbows 112 are respectively aligned with the mounting holes 21 of the first and second offset legs 10, 10'. The hinge pins 80 extend through the annular bearing surfaces in the elbows 112 and are securely received in the mounting holes 21 of the first and second offset legs 10, 10' and the open ends of the door hinge support 76. In this manner, the hinge pins 80 pivotally secure the hinge arms 110 to the first and second offset legs 10, 10'. The elongated members 111 of the hinge arms 110 are biased rearward by springs 114 connected between the elongated members 111 and the first and second horizontal legs 56, 56'. The springs 114 act as a counterbalance to the door 102. The door hinge support 76 extends behind the outer panel 105 and is spaced below the liner 104.

With the door 102 mounted to the frame 40 in the foregoing manner, the door 102 is pivotable about a horizontal axis passing through the hinge pins 80. The horizontal axis is spaced upward from a bottom edge of the door 102. Thus, the door 102 has a long bottom portion and is considered a "long door". The door 102 pivots about the horizontal axis between a closed position and an open position. In FIG. 3, the door 102 is shown in the open position. In the closed position, the door 102 is vertical and covers the access opening 130 so as to prevent wash fluid from being ejected out of the tub 120 and into the outside environment. In the open position, the door 102 is horizontal and is spaced from the access opening 130 so as to permit access to the tub 120.

With regard to each of the first and second offset legs 10, 10', the nose 18 and the neck 16 together are longer than the bottom portion of the door 102. Accordingly, when the door 102 is pivoted from the closed position to the open position, the bottom portion of the door 102 pivots underneath the noses 18 and the necks 16 of the first and second offset legs 10, 10'. Thus, the first and second offset legs 10, 10' are able to accommodate the bottom portion of the door 102 and still permit the front frame 42 to be disposed around the collar 136 of the tub 120.

The frame 40 supports and secures the tub 120 and other components of the washer 100. The front frame 42 helps prevent lateral movement and vertical deformation of the tub 120, while the rear frame 50, the first and second offset legs 10, 10', and the front brace 72 support the tub 120 and other components of the washer 100 on a surface. The rear frame 50 also engages the bottom wall 121 of the tub 120 so as to prevent forward, rearward and vertical movement of the tub 120. The door hinge support 76 helps maintain the proper orientation of the first and second offset legs 10, 10' so as to improve the seal between the door 102 and the tub 120.

Figure 4:
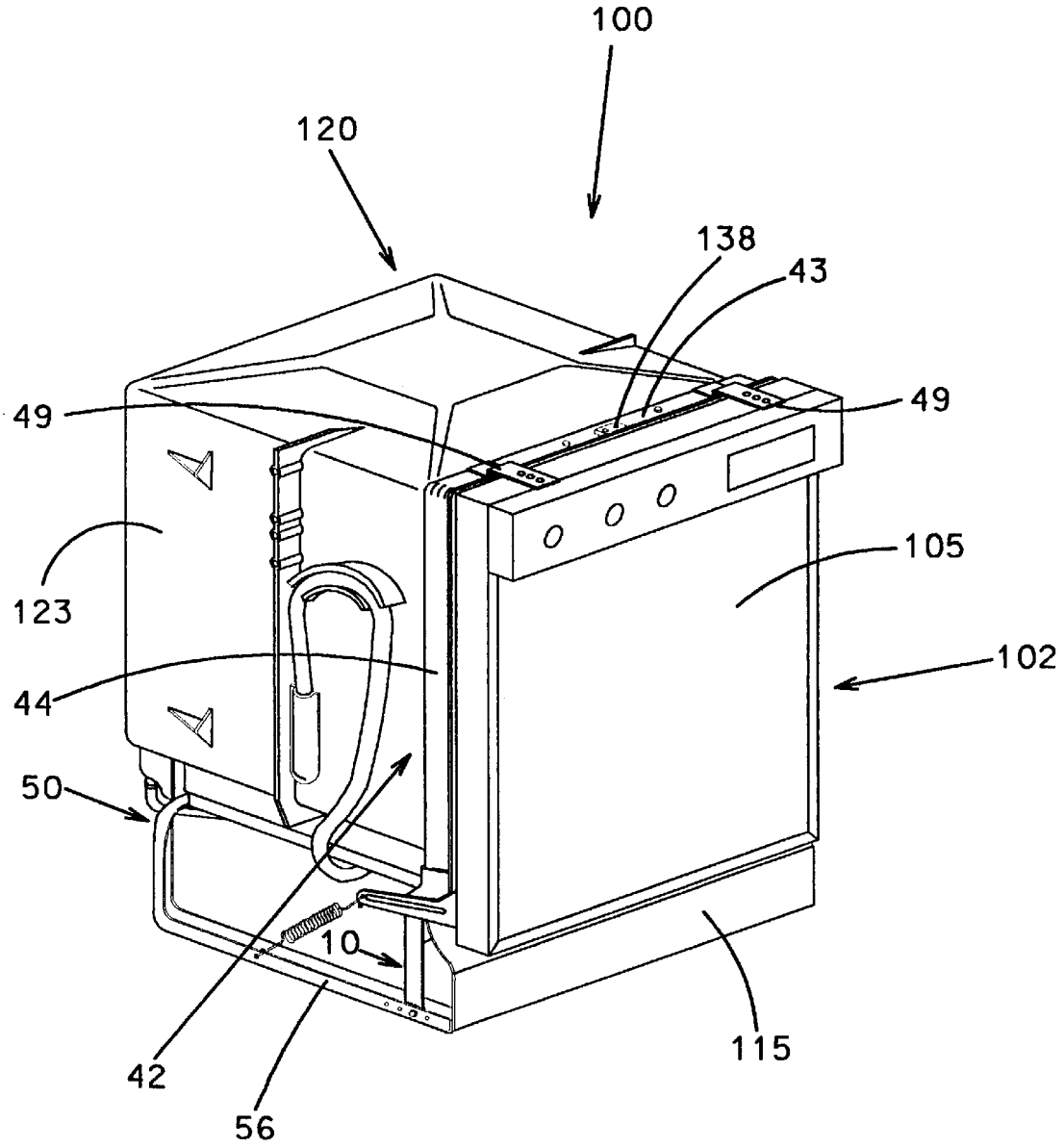
FIG. 4 shows a front perspective view of the washer with a kickplate mounted in front of the offset legs.

In FIG. 3, the frame 40 contacts the surface and directly supports the tub 120 and other components of the washer 100 on the surface as would occur if the washer 100 was installed under a counter. If the washer 100 is to be installed under a counter, a kickplate 115 is mounted in front of the first and second offset legs 10, 10' as is shown in FIG. 4. The kickplate 115 extends between the first and second offset legs 10, 10' and is secured to the outer ends 56*a*, 56*a'* of the rear frame 50. The washer 100 is then connected to appropriate household utitlities and is slid into a space under the counter. The mounting clips 49 have forward ends that are secured to a bottom surface of the counter by screws or other means.

Figure 5:
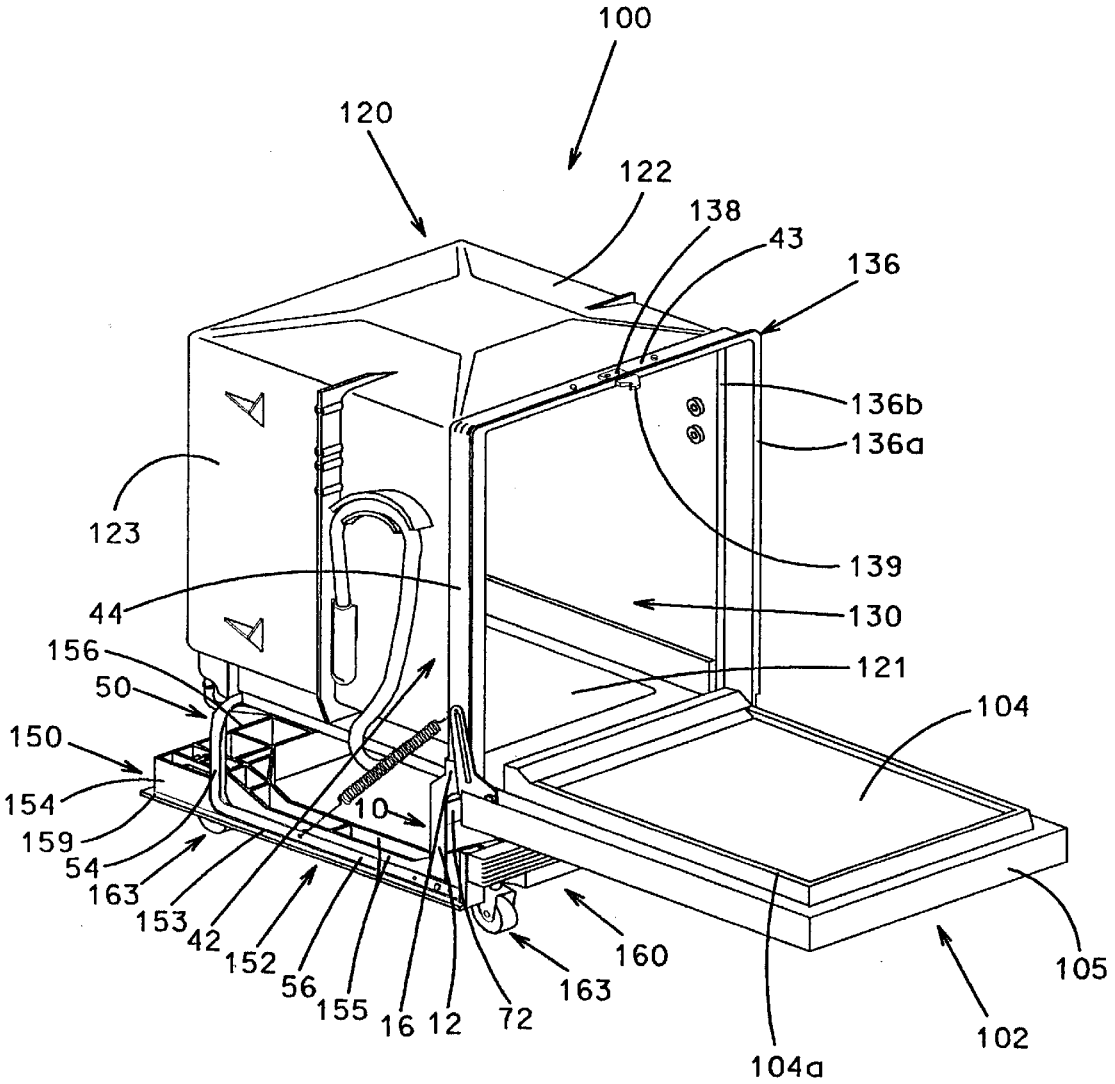
FIG. 5 shows a front perspective view of the washer mounted on a base.

It should be appreciated, however, that the first and second offset legs 10, 10' of the present invention are not limited to use in a washer that is for under-the-counter installation. The first and second offset legs 10, 10' can be used in a washer that is portable. Referring now to FIG. 5 the frame 40 of the washer 100 is shown mounted to a base 150. The base 150 is supported on four caster assemblies 163 that make the washer 100 portable.

The base 150 embodies a construction disclosed in assignee's co-pending application entitled "Structural Foam Base for Portable Dishwasher", Ser. No. 08/689,525, U.S. Pat. No. 5,741,054, which is incorporated herein by reference. The base 150 is composed of a structural foam material formed into the shape of a rectangular frame. The structural foam material is talc-filled or glass-filled polypropylene or some other type of plastic material. The base 150 includes a grille 160, a rear structure 156, a first side structure 152 and a second side structure (not shown). A perimeter flange 159 extends around the first side structure 152, the second side structure, and the rear structure 156 so as to have first and second side portions and a rear portion. The rear portion and the first and second side portions of the perimeter flange 159 each define a pair of holes.

The first side structure 152 and the second side structure each include a raised side surface 153, a corner 154 and a pair of side walls 155. The side walls 155 are spaced-apart in parallel fashion and extend between the grille 160 and the corner 154. The side walls 155 slope downward from their ends to a central horizontal portion. An outer one of the side walls 155 adjoins the raised side surface 153 at a substantially right angle so as to form an angled surface.

The raised side surface 153 extends rearward from the grille 160 for a distance and then curves upward to join the corner 154. The raised side surface 153 is slightly elevated above the perimeter flange 159, which runs adjacent to the raised side surface 153. A plurality of bores are formed in the raised side surface 153.

The first and second horizontal legs 56, 56' are respectively secured to the raised side surfaces 153 of the base 150 by screws or bolts that pass through the vertical holes 57 in the first and second horizontal legs 56, 56' and the bores in the raised side surfaces 153. In this manner, the first and second horizontal legs 56, 56' are supported both laterally and vertically by the angular surfaces formed by the outer ones of the side walls 155 and the raised side surfaces 153.

Although the preferred embodiments of this invention have been shown and described, it should be understood that various modifications and rearrangements of the parts may be resorted to without departing from the scope of the invention as disclosed and claimed herein.

What is claimed is:

1. A washer for placement on a surface, said washer comprising:

a tub defining a wash chamber with a front opening, said tub having a bottom wall and opposing side walls;

a front frame having a pair of legs respectively disposed adjacent to the opposing side walls of the tub toward the front opening;

a pair of offset legs that help vertically support the tub above the surface, said offset legs each having a neck and an upright member longitudinally offset from each other, said necks being respectively secured to the legs of the front frame.

2. The washer of claim 1 wherein the offset legs each further comprise a nose joined to the neck and extending forward therefrom.

3. The washer of claim 2 further comprising:

a door pivotally mounted to the noses of the offset legs, said door being pivotable between an open position wherein the door is substantially horizontal and is spaced from the front opening and a closed position wherein the door is substantially vertical and closes the front opening.

4. The washer of claim 3 wherein the door further comprises a bottom portion that pivots underneath the noses and the necks of the offset legs when the door is moved from the closed position to the open position.

5. The washer of claim 4 wherein the offset legs each further comprise a shoulder joined between the upright member and the neck, said shoulders offsetting the necks forward of the upright members so as to position the front frame toward the front opening while permitting the bottom portion of the door to pivot underneath the noses and the necks.

6. The washer of claim 5 wherein the offset legs are composed of metal, and wherein in each of the offset legs, the upright member, the neck, the shoulder and the nose are integral.

7. The washer of claim 1 further comprising a rear frame that helps support the tub above the mounting surface, said rear frame comprising:

a pair of vertical supports disposed rearward of the offset legs, said vertical supports each having upper and lower ends; and a pair of horizontal legs having outer ends, said horizontal legs being respectively secured to the lower ends of the vertical supports and extending forward therefrom to the outer ends, said horizontal legs being respectively secured to the upright members of the offset legs toward the outer ends.

8. The washer of claim 7 further comprising a front brace secured between the upright members of the offset legs.

9. The washer of claim 8 wherein the rear frame further comprises a horizontal cross bar secured between the upper ends of the vertical supports, and wherein the horizontal cross bar and the front brace supportively contact the bottom wall of the tub.

10. The washer of claim 9 wherein the front brace is secured between the upright members of the offset legs by metal clinches formed between the front brace and the upright members, and wherein the necks of the offset legs are secured to the legs of the front frame by metal clinches formed between the necks and the legs.

11. The washer of claim 7 wherein the upright members of the offset legs each have an indented lower end with a hole formed therein, and wherein the horizontal legs of the rear frame each have a vertical flange with a lateral bore formed therein toward the outer end.

12. The washer of claim 11 wherein the horizontal legs of the rear frame are respectively secured to the upright members of the offset legs by bolts extending through the holes in the indented lower ends of the upright members and the lateral bores in the vertical flanges of the horizontal legs.

13. A washer comprising:

a tub defining a wash chamber with a front opening, said tub having a bottom wall and opposing side walls;

a front frame having a bight with a pair of legs extending downward therefrom, said legs being respectively disposed adjacent to the opposing side walls of the tub toward the front opening;

a rear frame having a pair of horizontal legs with outer ends and a pair of vertical supports disposed rearward from the legs of the front frame, said horizontal legs being secured to the vertical supports and extending forward therefrom to the outer ends; and a pair of offset legs each having a neck and an upright member longitudinally offset from each other, said necks being respectively secured to the legs of the front frame and said upright members being respectively secured to the horizontal legs toward the outer ends.

14. The washer of claim 13 wherein the offset legs each further comprise a nose joined to the neck and extending forward therefrom, said noses each defining a hole.

15. The washer of claim 14 further comprising:

a pair of hinge arms each having an opening formed therein;

a door having a pair of opposing sides to which the hinge arms are respectively secured, said door being disposed between the offset legs such that the openings in the hinge arms are respectively aligned with the holes in the noses of the offset legs;

a pair of hinge pins extending through the openings in the hinge arms and the holes in the noses of the offset legs so as to pivotally mount the door to the offset legs, said door being pivotable between an open position wherein the door is substantially horizontal and is spaced from the front opening and a closed position wherein the door is substantially vertical and closes the front opening.

16. The washer of claim 15 wherein the door further comprises a bottom portion that pivots underneath the noses and the necks of the offset legs when the door is moved from the closed position to the open position.

17. The washer of claim 16 wherein the necks of the offset legs are offset forward of the upright members of the offset legs so as to position the front frame toward the front opening, while permitting the bottom portion of the door to pivot underneath the noses and the necks of the offset legs.

18. The washer of claim 13 wherein the washer is for installation under a counter and wherein the washer further comprises a pair of mounting clips secured to the bight of the front frame and extending forward therefrom, said mounting clips having forward ends for securement to the counter.

19. The washer of claim 18 further comprising a kick-plate disposed in front of the offset legs and extending therebetween.

20. A portable washer comprising:

a tub defining a wash chamber with a front opening, said tub having a bottom wall and opposing side walls;

a front frame having a bight with a pair of legs extending downward therefrom, said legs being respectively disposed adjacent to the opposing side walls of the tub toward the front opening;

a rear frame having a pair of horizontal legs and a pair of vertical supports, said vertical supports being disposed rearward from the legs of the front frame and said horizontal legs being secured to the vertical supports and extending forward therefrom;

a pair of offset legs each having a neck and an upright member longitudinally offset from each other, said necks being disposed forward of the upright members and being respectively secured to the legs of the front frame, said upright members being respectively secured to the horizontal legs; and a base to which the horizontal legs of the rear frame are secured, said base having a plurality of casters extending downward therefrom.

* * * * *